US005507129A

United States Patent [19]

Joson et al.

[11] Patent Number: 5,507,129

[45] Date of Patent: Apr. 16, 1996

[54] AUTOMATIC DOCUMENT FEEDER FOR FOLDING AND/OR INSERTING MACHINE

[75] Inventors: Michel Joson, Fontenay-Tresigny; Marek Krasuski, Fontenay aux Roses; Frédéric Trescazes, Paris, all of France

[73] Assignee: Neopost Industrie, Bagenux, France

[21] Appl. No.: 364,682

[22] Filed: Dec. 28, 1994

[30] Foreign Application Priority Data

Dec. 30, 1993 [FR] France ..... 93 15909

[51] Int. Cl.[6] ..... B65B 5/04; B65B 59/04

[52] U.S. Cl. ..... 53/55; 53/117; 53/284.3; 53/569

[58] Field of Search ..... 53/284.3, 460, 53/201, 569, 64, 116, 117, 381.5, 381.6, 55

[56] References Cited

U.S. PATENT DOCUMENTS 4,924,652 5/1990 Krasuski et al. ..... 53/284.3 X
4,944,131 7/1990 Gough ..... 53/284.3 X
5,183,526 2/1993 Walter .
5,216,472 6/1993 Muto et al. .

FOREIGN PATENT DOCUMENTS

0352692A1 1/1990 European Pat. Off. .
0485797A1 5/1992 European Pat. Off. .
2691703A1 12/1993 France .

*Primary Examiner*—Horace M. Culver
*Attorney, Agent, or Firm*—Sughrue, Mion, Zinn, Macpeak & Seas

[57] ABSTRACT

An automatic document feeder for a folding and/or inserting machine has a document entry surmounted by at least two loading bins adapted to cooperate with the document entry in various modes of operation, individually or in combination, using a set of sensors and drive units and controlled by a programmed microprocessor of a control circuit via an input/output interface circuit in the feeder.

14 Claims, 5 Drawing Sheets

AUTOMATIC DOCUMENT FEEDER FOR FOLDING AND/OR INSERTING MACHINE

BACKGROUND OF THE INVENTION

1. Field of the Invention

The present invention relates to the specific field of mail processing. It is specifically concerned with an automatic document feeder for a folding and/or inserting machine as described in patents EP-A-O 352 692 and EP-A-O 485 797.

2. Description of the Prior Art

These office machines usually include a document feeder device, a magazine of empty envelopes and a filled envelope discharge device, all mounted on a frame. Each filled envelope has had at least one folded or unfolded document inserted in it.

The feed device is usually a loader in which documents are taken up one by one, either manually or automatically, from a stack of documents placed in the loader, with no possible combination of manual and automatic operation.

The invention proposes to improve this document feed device by giving it additional modes of operation intended to improve further the performance of the folding/inserting machine whilst making it more user-friendly, easier to use and easy to customize to the actual requirements of the user.

SUMMARY OF THE INVENTION

To this end, the invention consists in an automatic document feeder for a folding and/or insertion machine of the type including a first path coupled to a document entry and feeding a folder module with two folder pockets associated with a set of folder rollers, a second path coupled to an empty envelope entry and feeding an inserter module coupled to the folder module to receive the documents, a third path coupled to a filled and closed envelope exit and to the inserter module and having means for closing envelopes, and a control circuit, in which automatic feeder said document entry is surmounted by at least two loading bins adapted to cooperate with said entry in different modes of operation, individually or in combination, using a set of sensors and drive members controlled by a programmed microprocessor of said control circuit via an input/output interface circuit in said feeder, and at least one loading bin has a movable bottom adapted to assume either a closed position for automatic introduction of documents or an open position for manual introduction of documents, using a cam control mechanism.

Loading bins can be used in individual sheet manual feed mode or in individual sheet automatic feed mode, independently or in combination.

This makes the folding and/or inserting machine extremely flexible in use, thanks to a wide choice of operating modes combined with an extensive choice of document categories (dimensions, paper substance, quality, type, etc). The use of a plurality of loading bins in automatic mode, with the possibility of loading in time that would otherwise be wasted, also increases the productivity of the machine.

The possibility of converting the loading bin reduces the total number of bins and facilitates combined operations in mixed (manual and automatic) mode. The use of a dual function bin in the first row, facing the user of the machine, makes the machine particularly practical to use and improves its ergonomics.

Other features and advantages of the invention will emerge more clearly from the following description of a preferred embodiment of the invention given by way of example with reference to the appended drawings.

DETAILED DESCRIPTION OF THE PREFERRED EMBODIMENT

Figure 1A:
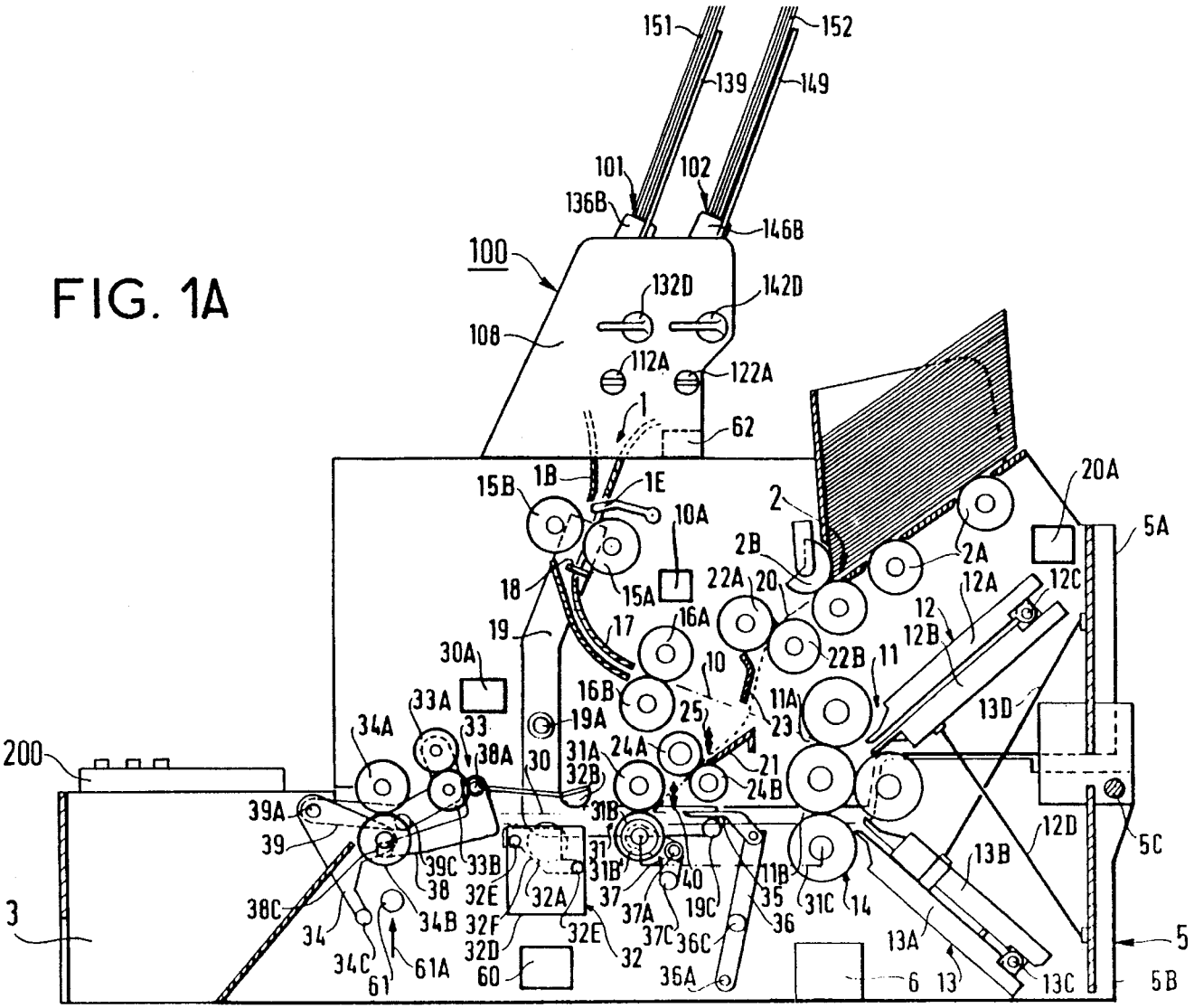
FIG. 1 is a diagrammatic representation of a folder/inserter equipped with an automatic document feeder of the invention.

Referring to FIG. 1, the folding and inserting machine of the invention is used to put documents such as letters into envelopes, preferably as and when the letters are produced. It is part of the equipment of a secretarial workstation, where it constitutes one of the machines available to the workstation operator. The machine of the invention is simply placed on the worksurface of the workstation to provide the operator with easy access to the workstation, in particular for placing in the machine the letters that the machine places in envelopes.

The machine has a letter entry 1 at the base of the feeder 100, a magazine 2 of empty envelopes and an exit 3 for filled and closed envelopes, all mounted on a frame 5 of the machine. The frame 5 is in two parts, namely an upper frame 5A and a lower frame 5B. The upper frame is open at the bottom and is hinged to the upper side of the lower frame 5B to pivot about a spindle 5C. This spindle 5C is carried by the lower frame and is near its rear wall when the machine is installed at a secretarial workstation. The upper frame 5A closes the lower frame 5B to which it is locked by known releasable locking means (not shown).

The letter entry 1 and the empty envelope magazine are on the top of the upper frame 5A, with the entry 1 nearer the front than the empty envelope magazine 2. The filled and closed envelope outlet 3 is at the bottom and at the front of the lower frame 5B. The letters are therefore easily inserted at the entry 1 and the closed envelopes are easily taken up from the exit 3; empty envelopes are loaded in batches into the magazine 2 which constitutes the empty envelope entry and this avoids manual insertion of each empty envelope at the empty envelope entry.

A letter path 10 in the machine leads from the letter entry 1 to a folder module 11. The folder module 11 has two folder pockets 12 and 13 associated with a set of folder rollers 14. The path 10 defines the trajectory of the letters transferred from the entry 1 to the folder module 11. It forms a sharp bend guiding the letters from the entry 1 to the rear part of the upper frame 5A to feed them into the folder module, part of which is in the rear part of the frame 5A and the remainder of which is in the frame 5B. The folder module at the end of the path 10 changes the direction of the trajectory of the letters as it folds them.

An empty envelope path 20 in the machine leads from the empty envelope magazine 2 constituting the empty envelope entry. This path 20 intersects the letter path 10 and ends in the middle part of the machine. It has a substantially S-shape trajectory and is equipped with means 21 for opening the flap of the empty envelopes.

A filled envelope path 30 leads to the filled envelope outlet 3. This path 30 is substantially linear; it extends over the outlet 3 between the upper frame 5A and the lower frame 5B from the front part of the machine to the empty envelope path 20 and is substantially aligned with the letter outlet of the folder module 11. The path 30 includes a functional module 31 for inserting letters into empty envelopes, a functional module 32 for moistening the flaps and a module 33 for folding the flaps closed.

The folder module 11, the inserter module 31 and the moistener module 32 are "functional" modules in the sense that they are split apart on opening of the upper frame 5A on the lower frame 5B.

A control circuit 6 produces machine commands during a control cycle. It is connected to an interface circuit 62 specific to the feeder 100.

Various components of the machine are specified hereinafter relative to the document feeder part.

The letter entry 1 of the machine forms a stand which extends over the upper frame 5A with a slight inclination to the vertical, with the lower end at the front. This stand is constituted by the automatic feeder which is the subject matter of the present invention.

On the outside of the frame the entry chute 1 fastened to the feeder is tapered to facilitate the insertion of letters. Inside the frame it is coupled to the path 10 and constitutes means of controlled access to the letter path 10.

The letter path 10 is defined by two sets of drive rollers 15A, 16A with their associated two sets of pressure rollers 15B, 16B and an intermediate guide chute 17 which is bent sharply and is formed by a pair of deflectors. It can include a coupling chute (not shown) between the set of rollers and pressure rollers 16A, 16B and the folder module. This coupling chute is substantially linear; it is interrupted for the empty envelope path 20 which intersects the letter path 10 at its level or extends on one side only of the path 20. The rollers and pressure rollers 15A, 15B and 16A, 16B and the chute 17 are mounted on the upper frame 5A.

The pair of sets of rollers and pressure rollers 15A, 15B is mounted with a set of closure fingers 18 on the end part of the chute 1 inside the frame 5A to provide controlled means of access to the letter path 10.

The set of rollers 15A is mounted on one side of the chute 1 and projects through the lower end of the entry plate, just inside the chute 1. The set of pressure rollers 15B is pivotally mounted at the other side of the chute 1, facing the set of rollers 15A. It is carried by a spindle resting in a window enabling it to move relative to the set of rollers 15A. The set of rollers 15 is controlled by a pair of arms 19 pivoted about a spindle 19A carried by the upper frame 5A. It pivots about this spindle 19A between a position out of the chute 1 and not in contact with the set of rollers 15A (its rest position) and a position in which it projects into the chute 1 and is pressed against the set of rollers 15A (this is its command position).

The set of closure fingers 18 is also pivotally mounted opposite the entry chute 1 under the pair of rollers 15A and pressure rollers 15B.

It is advantageously carried by the pair of arms 19 controlling the set of pressure rollers 15B, so that it is commanded at the same time as them. It pivots about the spindle 19A between an obstacle position projecting through the chute 1, which it closes off (this is its rest position), and a position retracted out of the chute (this is its command position).

When the set of pressure rollers 15B and the set of closure fingers 18 are in their rest position a letter inserted at the entry 1 moves along the entry plate 1A, is inserted between the sets of rollers and pressure rollers 15A, 15B and stops at the set of closure fingers 18 which are closing off the chute 1. The set of closure fingers also acts as a tamping abutment for a plurality of documents inserted simultaneously into the entry chute 1. In its rest position the set of closure fingers isolates the entry 1 from the internal path 10. In its command position the set of closure fingers is retracted and opens the chute 1 and the set of pressure rollers 15B pressing on the set of rollers 15A drives the letter along the letter path 10.

In the embodiment shown the pair of arms 19 is articulated about the spindle 19A carried by the upper frame 5A substantially in the middle of its lower part. This pair of arms extends towards the top of the upper frame, on either side of the sharply bent chute 17. Its upper end provides an abutment for the spindle of the set of rollers 15B. The set of rollers 15B is held away from the set of rollers 15A or pressed resiliently against it. Below this upper end the pair of arms 19 carries the set of closure fingers which are inserted between the chute 17 and the entry chute from the interior side of the sharp bend in the chute 17 to isolate them or are retracted under the set or rollers 15A. The pair of arms 19 extends beyond the pivot spindle into the lower frame, from which it is operated. Each arm is substantially L-shaped with the pivot spindle partway along the longer leg of the L. The pair of arms 19 actuates the closure fingers 18 and the pressure rollers 15B, the latter delayed relative to the former.

The folder module 11, the letter path 10, the empty envelope entry 2 and the envelope path 20, the filled envelope path 30 with the moistening module 32 and the closer module 33 and the control circuit 6 are described in detail in patent EP-A-0 352 692.

The present invention is specifically concerned with the construction of the letter entry 1 in the feeder 100. The document feeder includes two loading bins 101, 102 formed inside a feeder body 103. The feeder body includes a support plate 104 with two side flanges 105, 106 covered by respective embellishers 107, 108. It fits and clips onto the top of the upper frame 5A at two front fixing lugs 109 and two flexible blade lateral locking lugs, not shown (see FIGS. 1A, 1B and 2).

The loading bin 101 essentially comprises:

- a tilting bottom 113 over which is a plate 113A constituted by a skid covered with a rough separator coating and pivoted about a spindle 119 fixed to the flanges 105, 106;
- a perforated pressure plate 111 pivoted to the flanges 105, 106 by two pins 130, pivoting against the action of a return spring 112;
- two feeders 136A, 136B sliding in synchronism over the pressure plate 111 and driven by a rack, not shown;
- a support hoop 139 for holding documents 151 in an inclined position aligned with and adjacent the feeders 136A, 136B; the ends of this hoop are fixed to the side flanges 105, 106;
- a roller 110 for picking documents 151, driven by the motor 10A through a clutch, not shown.

The loading bin 102 essentially comprises:

a fixed bottom 123 which is an integral part of the support plate 104 and which is provided with a plate 123A constituted by a skid covered with a rough separator coating;

a perforated pressure plate 121 pivoted to the flanges 105, 106 by two pins 140, pivoting against the action of a return spring 122;

two feeders 146A, 146B sliding in synchronism over the pressure plate 121 and driven by a rack, not shown;

a hoop 149 for supporting documents in an inclined position aligned with and adjacent the feeders 146A, 146B, the ends of this hoop being fixed to the side flanges 105, 106;

a roller 120 for picking documents 152 driven by the motor 10A through a clutch, not shown.

Figure 2:
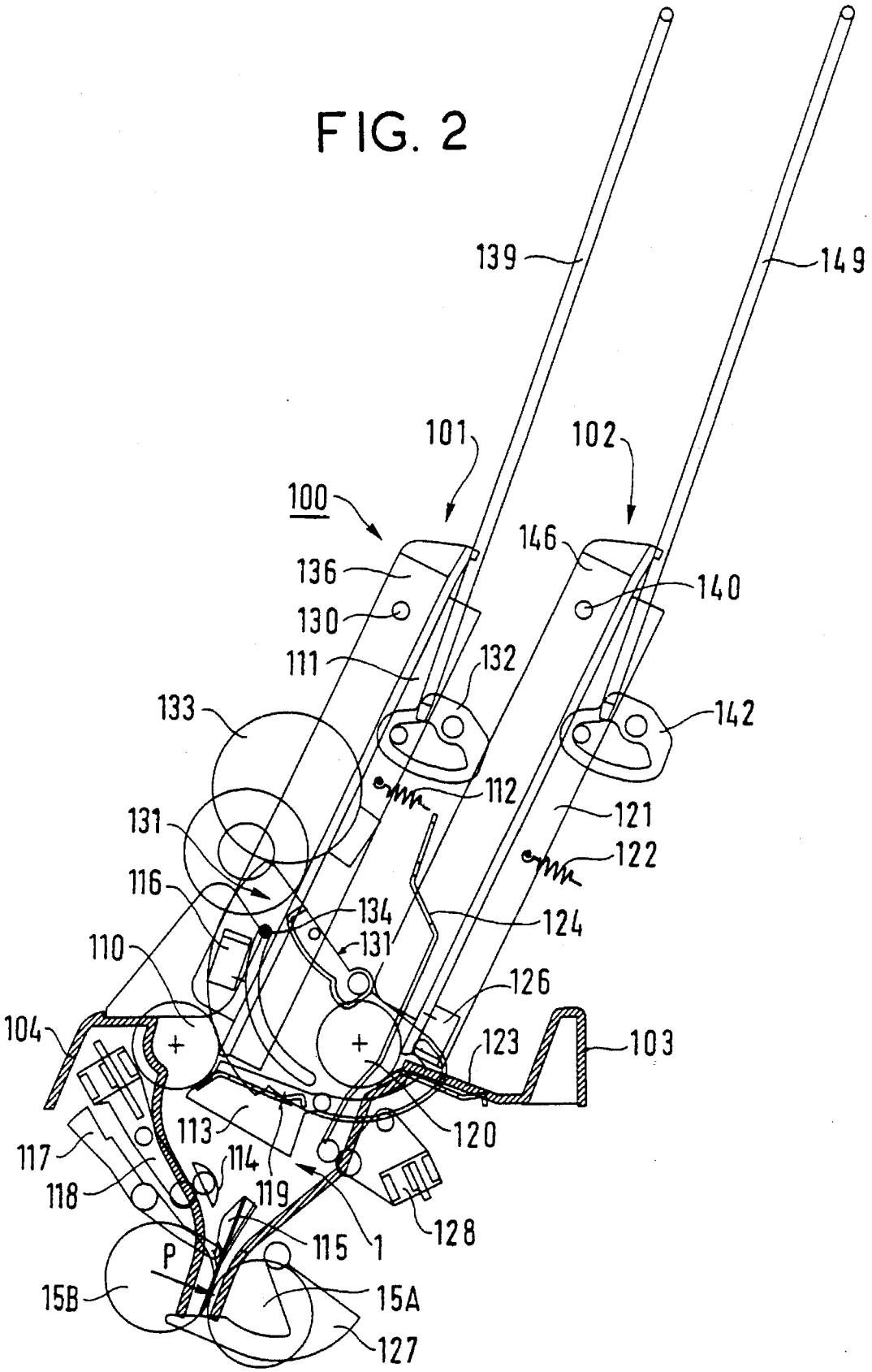
FIGS. 2 and 3 are two diagrammatic views in section of the feeder shown in FIG. 1, respectively in an automatic operating mode and in a semi-automatic operating mode.
Figure 3:
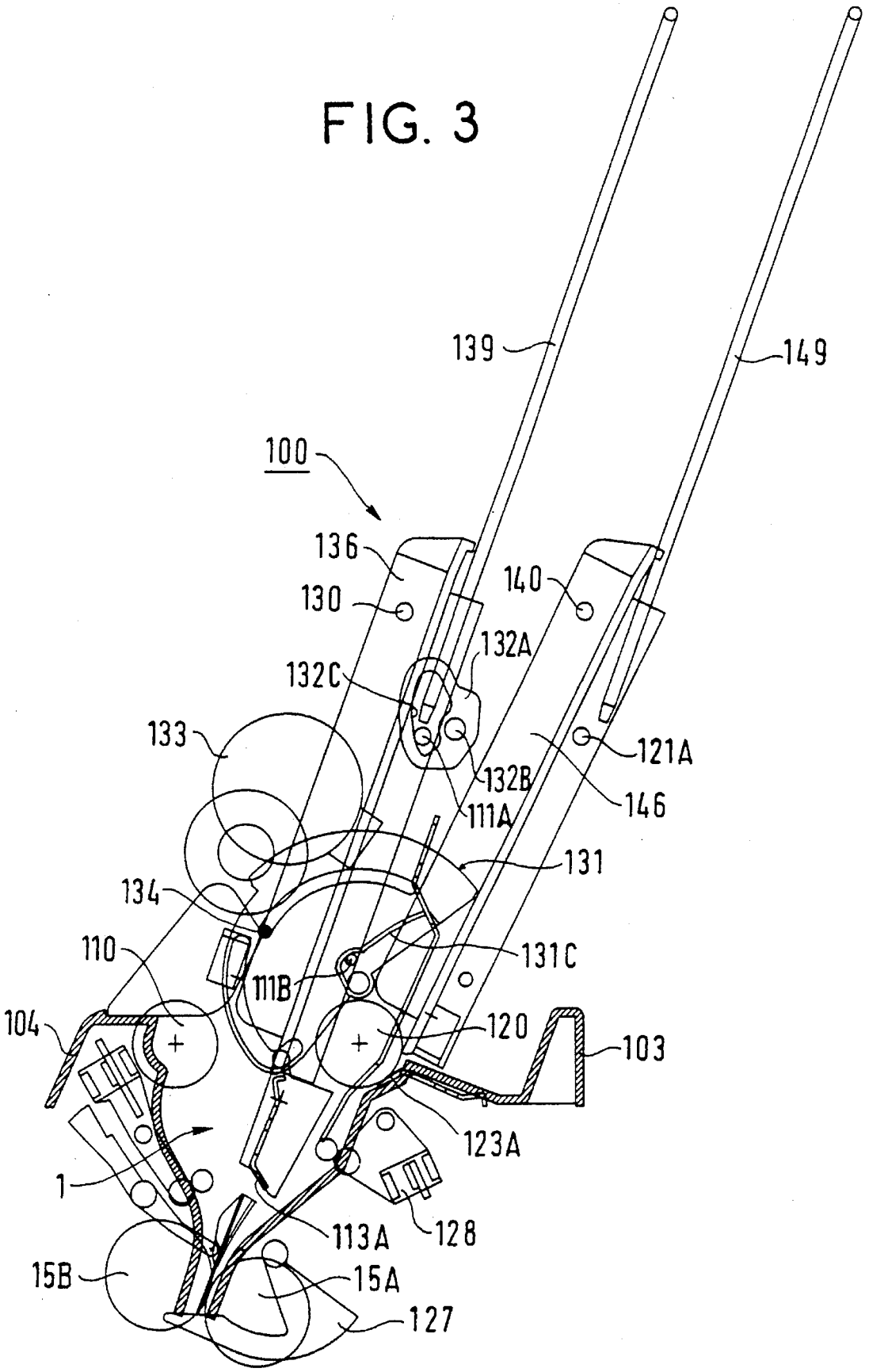
Figure 4:
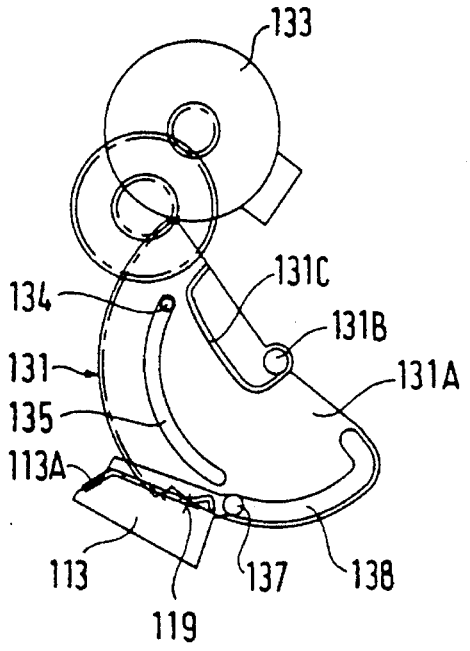
FIGS. 4 and 5 are two diagrammatic views in section of a cam control mechanism of the feeder shown in FIGS. 2 and 3, shown in positions corresponding to those figures, respectively.
Figure 5:
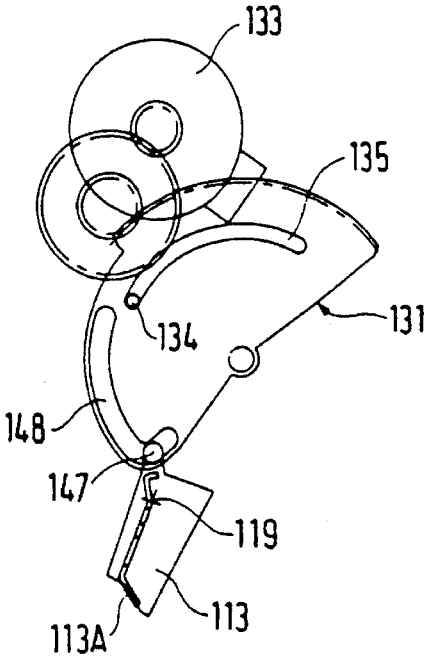

The support plate 104 of the feeder body 103 is extended at its lower end by the entry chute 1 for documents from the loading bins 101, 102 (see FIGS. 2 and 3).

The entry chute encloses two deflectors 114, 124 and a separator 115 on the upstream side of the drive roller 15A and its pressure roller 15B.

The automatic feeder also has sensors 116, 126 for detecting the presence of respective documents 151, 152, sensors 117, 127 for detecting the passage of documents and sensors 118, 128 for detecting multiple feeding of documents. These sensors are all Hall effect sensors.

A cam mechanism 131 simultaneously pivots the bottom 113 of the loading bin 101 and disengages the pressure plate 111.

As shown in FIGS. 2 through 5, this mechanism includes a cam 131A pivoted on a spindle 131B fastened to the flanges 105, 106. A first curved opening 135 cooperates with an abutment 134 fastened to the flanges 105, 106. A retractor finger 137 fastened to the tilting bottom 113 slides in a second curved opening 138. A cam surface 131C cooperates with a control pin 111B on the pressure plate 111. The cam mechanism is driven by a motor 133.

The drive motor 133 is preferably a stepper motor with open loop control for movement between two limiting positions defined by the abutment 134 and the path 135. The motor 133 is started in the appropriate direction to reach the required limiting position.

A manual control mechanism 132 is associated with the pressure plate 111 to enable loading of documents 151 into the bin 101 by disengaging this plate. This mechanism includes a cam 132A pivoted on a spindle 132B fastened to the flanges 105, 106 and cooperating with a control pin 111A on the pressure plate 111 via a cam surface 132C. A pressure plate disengaging lever 132D is mounted on the spindle 132B on the outside lateral surface of the embellisher 108 (see FIGS. 1A and 1B). These figures also show a paper substance selector 112A mounted on the same outside lateral surface. This can be set to any of a number of detent positions corresponding to different tensions on the return spring 112. In a similar manner, the loading bin 102 has a similar manual control mechanism 142, a control lever 142D and a selector 122A.

In another embodiment this independent control function is motorized using a stepper motor or a DC motor controlled by the control circuit 6, 62.

Figure 1B:
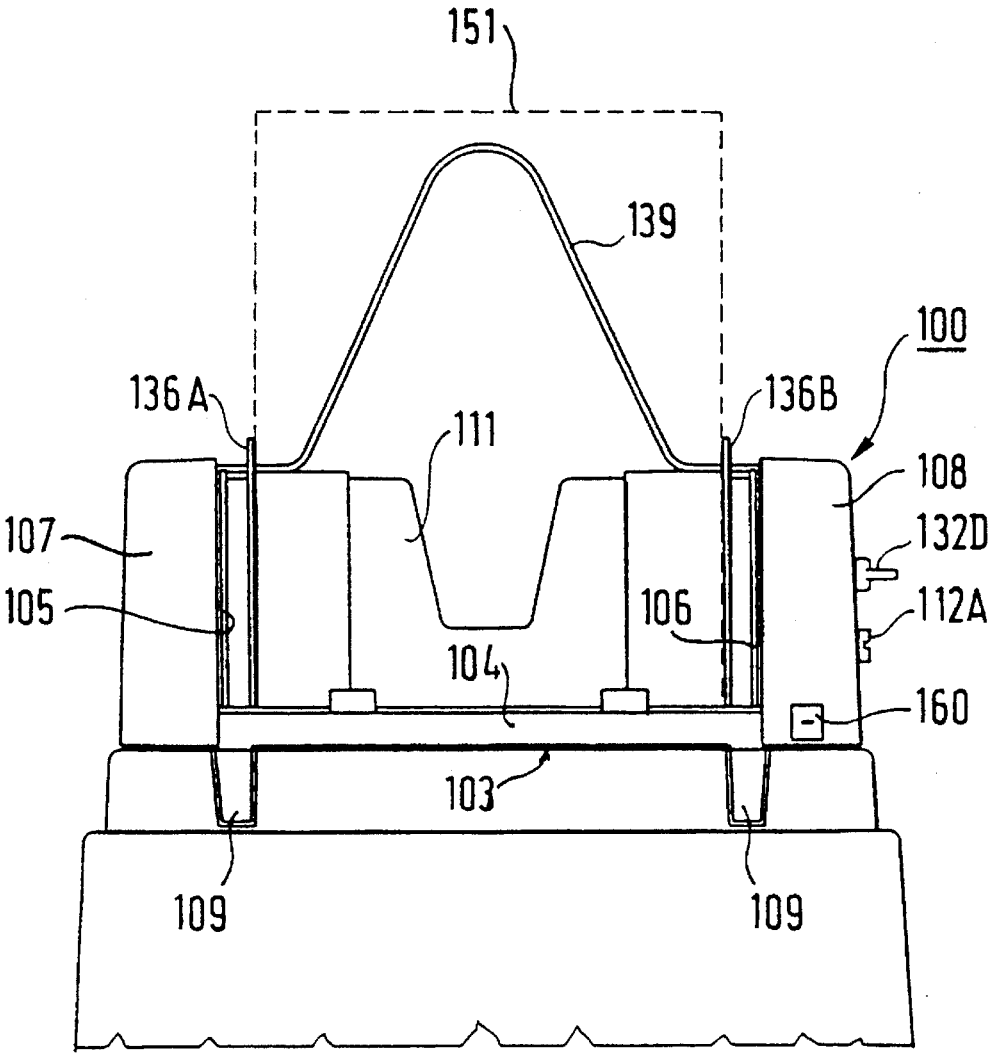
Figure 6:
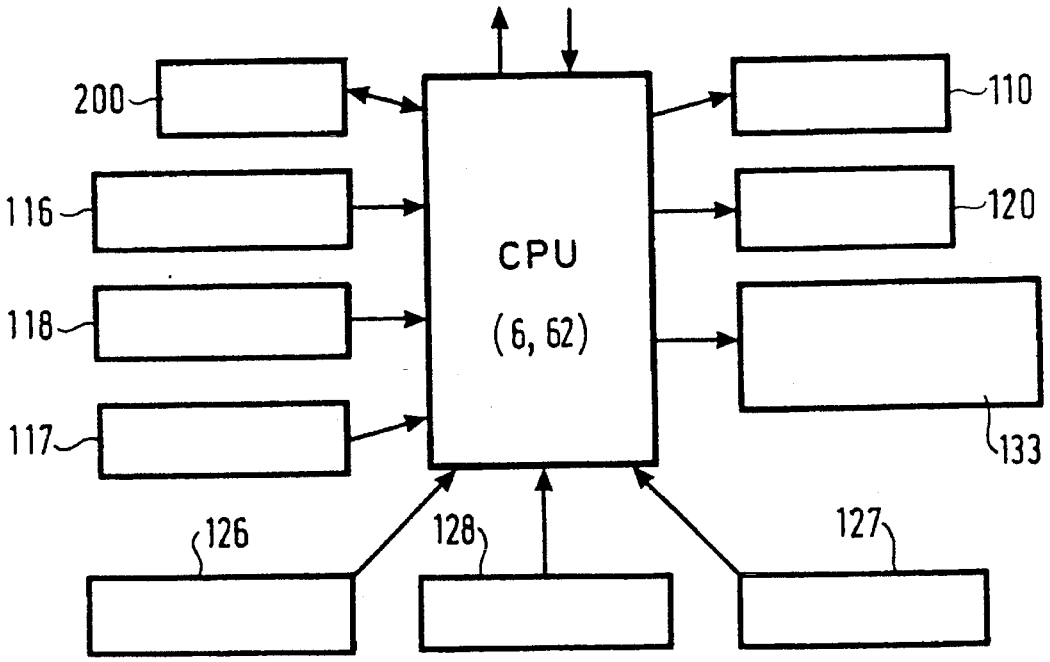
FIG. 6 is a functional block diagram of the control system for the feeder shown in the previous figures.

A button 160 is provided for disabling the multiple document sensors 118, 128 if this function is not required (see figure 1B). Referring to FIG. 6, the control circuit 6 uses the sensors 117, 127 to position and align documents from the automatic bins 101 and/or 102 or from the automatic bin 102 and the manual bin 101 at the document entry abutment. It operates on the control system (not shown) for the document picking rollers 110, 120. These control means comprise either motors or clutches if a single motor is used for both bins. The document sensors 116, 126 are used by the control circuit via the interface 62 for operation as follows:

in mixed mode if a manual mode has been chosen for the bin 101 and the bin 102 is not empty, cycling between the two loading bins if the automatic mode has been chosen at one bin and both bins are not empty.

The automatic feeder 100 previously described offers the following operating modes:

automatic picking, one by one, of the documents placed in the bin 101 or the bin 102; loading one bin while the other is in use, i.e. in time that would otherwise be wasted, avoids the need to stop the machine to feed it with documents;

automatic picking of documents made up of two sheets, one from each of the respective bins 101, 102;

manual picking of a document from bin 101, accompanied by automatic picking of a document from bin 102 (this is the mixed mode of operation);

manual picking of a document from bin 101.

The mode of operation is simplicity itself to select from the control panel 200 which has keys and a display (not shown) which the user employs to choose:

* a manual mode and a mixed mode with immediate starting or starting on pressing a button in manual mode: the loading bin 102 is empty, a document 152 is placed by hand in the loading bin 101. The tilting bottom 113 is open and the pressure plate 111 is in the disengaged position to place the bin 101 in the manual configuration (see FIG. 3). Spontaneously, or after a "start" button is pressed, the machine starts a cycle in which the document is folded and inserted in an empty envelope and, where applicable, the filled envelope is closed, as described in patent EP-A-0 352 692.

in mixed mode: documents 152 are placed in the bin 102. When a document 151 is placed manually in the loading bin 101 a document 152 is picked from the bin 102 to descend to an entry position, either spontaneously or after a "start" button is pressed. The machine then folds the two documents simultaneously and inserts them simultaneously into an empty envelope. Where applicable, it closes the filled envelope.

* an automatic mode

The documents 151, 152 are placed in the bin(s) 101 and/or 102. When the "start" button is pressed the documents are picked from the non-empty bin(s) 101 and/or 102.

In this automatic configuration of the bin 101 the tilting bottom 113 is closed, the pressure plate 111 is engaged and the plate is active.

* a sequential automatic mode

If a loading bin 101, 102 is not empty when the "start" button is pressed, the automatic mode of operation is a sequential mode of operation, i.e. involving alternate use of the two bins.

The feeder 100 as described above is highly compact with good ergonomics by virtue of the possible conversion of the loading bin 101 at the front, facing the user.

Two bins provide the same functionality as three non-convertible bins: one manual bin and two automatic bins.

The deflector 114 and the separator 115 can also carry the roller or a bearing surface of a lever for detecting multiple documents.

In an alternative embodiment of the invention a single multiple document sensing device is provided on the common part P (see FIG. 2) of the path of the documents 151, 152. In this case, a measurement lever bears against a fixed bearing surface through a document. This lever is raised by a cam driven by a stepper motor during feeding of the document, in order not to impede movement of the paper. The control software stops the machine in response to double or multiple document feeding and determines the cause of this fault.

There is claimed:

1. Automatic document feeder for a folding and/or insertion machine of the type including a first path coupled to a document entry and feeding a folder module with two folder pockets associated with a set of folder rollers, a second path coupled to an empty envelope entry and feeding an inserter module coupled to the folder module to receive the documents, a third path coupled to a filled and closed envelope exit and to the inserter module and having means for closing envelopes, and a control circuit, in which automatic feeder said document entry is surmounted by at least two loading bins adapted to cooperate with said entry in different modes of operation, individually or in combination, using a set of sensors and drive members controlled by a programmed microprocessor of said control circuit via an input/output interface circuit in said feeder, and at least one loading bin has a movable bottom adapted to assume either a closed position for automatic introduction of documents or an open position for manual introduction of documents, using a cam control mechanism.

2. Automatic feeder according to claim 1 wherein a first of said loading bins is positioned nearer a control panel of said machine and is a convertible bin with a tilting bottom.

3. Automatic feeder according to claim 1 comprising a body including a support plate with two side flanges covered by respective embellishers and fitting and clipping to the top of an upper frame of said machine at two front fixing lugs and two flexible blade side locking lugs.

4. Automatic feeder according to claim 3 wherein said loading bin with said movable bottom includes:

a tilting bottom surmounted by a plate constituted by a skid covered with a rough separator coating and pivoted on a spindle fixed to said flanges;

a pressure plate pivoted to said flanges by two pins, said plate pivoting against the action of a return spring;

two feeders sliding synchronously over said pressure plate and moved by a rack;

a hoop for supporting documents in an inclined position aligned with and adjacent said feeders and fixed at its ends to said side flanges;

a document picking roller driven by a motor through a clutch.

5. Automatic feeder according to claim 3 wherein one of said loading bins includes:

a fixed bottom which is an integral part of said support plate provided with a plate constituted by a skid covered with a rough separator coating;

a perforated pressure plate pivoted to said flanges by two pins, pivoting against the action of a return spring;

two feeders sliding synchronously over said pressure plate and moved by a rack;

a hoop for supporting documents in an inclined position in alignment with and adjacent said feeders, fixed at its ends to said side flanges;

a document picking roller driven by a motor through a clutch.

6. Automatic feeder according to claim 3 wherein said support plate of said feeder body is extended at its lower end by said entry chute for documents from said loading bins.

7. Automatic feeder according to claim 6 wherein said entry chute encloses document deflectors and separators.

8. Automatic feeder according to claim 1 comprising sensors for detecting the presence of documents, sensors for detecting the passage of documents and sensors for detecting multiple documents.

9. Automatic feeder according to claim 4 wherein pivoting of said bottom of said convertible loading bin and disengagement of said pressure plate are commanded simultaneously by a cam mechanism.

10. Automatic feeder according to claim 9 wherein said cam mechanism includes a cam pivoted on a spindle fastened to said flanges and having a first curved opening cooperating with an abutment fastened to said flanges, a second curved opening in which slides a retractor finger fastened to said tilting bottom and a cam surface cooperating with a control pin of said pressure plate.

11. Automatic feeder according to claim 10 wherein said cam mechanism is driven by a stepper motor with open loop control for movement between two limiting positions defined by said abutment and said path.

12. Automatic feeder according to claim 4 wherein a manual control mechanism is associated with said pressure plate to enable loading of said convertible bin with documents by disengagement of said plate, said control mechanism including a loading cam pivoted on a spindle fastened to said flanges and cooperating with a control pin of said pressure plate through a cam surface, a pressure plate disengagement lever being mounted on said spindle and on the outside lateral surface of said embellisher.

13. Automatic feeder according to claim 4 wherein paper substance selectors act on return springs of said pressure plates in various detent positions.

14. Automatic feeder according to claim 12 wherein a button for disabling said multiple document sensors is provided near said control panel, said selectors and said pressure plate disengagement levers.

* * * * *